US009567927B2

(12) United States Patent
Maurice et al.

(10) Patent No.: US 9,567,927 B2
(45) Date of Patent: Feb. 14, 2017

(54) VALVE FOR A GAS FLOW CIRCUIT IN A VEHICLE

(71) Applicant: Valeo Systemes de Controle Moteur, Cergy Saint Christophe (FR)

(72) Inventors: Benoît Maurice, St Ouen L'Aumone (FR); Yoann Lemarchand, Fremecourt (FR)

(73) Assignee: Valeo Systemes de Controle Moteur, Cergy Saint Christophe (FR)

( * ) Notice: Subject to any disclaimer, the term of this patent is extended or adjusted under 35 U.S.C. 154(b) by 156 days.

(21) Appl. No.: 14/361,403

(22) PCT Filed: Nov. 30, 2012

(86) PCT No.: PCT/FR2012/052765
§ 371 (c)(1),
(2) Date: May 29, 2014

(87) PCT Pub. No.: WO2013/079880
PCT Pub. Date: Jun. 6, 2013

(65) Prior Publication Data

US 2014/0318637 A1 Oct. 30, 2014

(30) Foreign Application Priority Data

Dec. 1, 2011 (FR) ..... 11 61008

(51) Int. Cl.
*F02D 41/00* (2006.01)

(52) U.S. Cl.
CPC ..... *F02D 41/0077* (2013.01); *F02M 26/26* (2016.02); *Y10T 137/6579* (2015.04)

(58) Field of Classification Search
CPC ..... F02D 41/0077; Y10T 137/6579; Y02T 10/121

(Continued)

(56) References Cited

U.S. PATENT DOCUMENTS 4,543,996 A * 10/1985 Baron ..... B08B 9/0323 137/625.43
4,653,537 A * 3/1987 Voith ..... F16K 11/0836 137/625.43

(Continued)

FOREIGN PATENT DOCUMENTS

DE 199 36 457 A1 2/2001
DE 10 2007 007111 A1 8/2008

(Continued)

OTHER PUBLICATIONS

International Search Report issued in PCT/FR2012/052765 mailed on Feb. 27, 2013 (6 pages).

*Primary Examiner* — Joseph Dallo
(74) *Attorney, Agent, or Firm* — Osha Liang LLP

(57) ABSTRACT

The invention relates to a valve (1) for regulating a gas flow in an EGR loop of a gas supply circuit of a vehicle engine, including a gas inlet (3), a first gas outlet (4) for directly feeding the gases into the supply circuit, and a second gas outlet (5) enabling said gases to flow into a pipe (6) passing through a cooler (2) before injecting said gases into said supply circuit, said valve (1) having a rotatable flap (7) capable of pivoting between a first position in which same blocks the second outlet (5) while at the same time opening the first outlet (4), and a second position in which same blocks the first outlet (4) while at the same time opening the second outlet (5). The main feature of a valve according to the invention is that the flap (7) includes a main flat body (11) capable of opening or closing the pipe (6) and that said pipe (6) has a flat rim (20), whereby the main body (11) of the flap (7) bears flatly against said rim (20) when said flap (7) is in the second position thereof.

8 Claims, 3 Drawing Sheets

Figure 1:
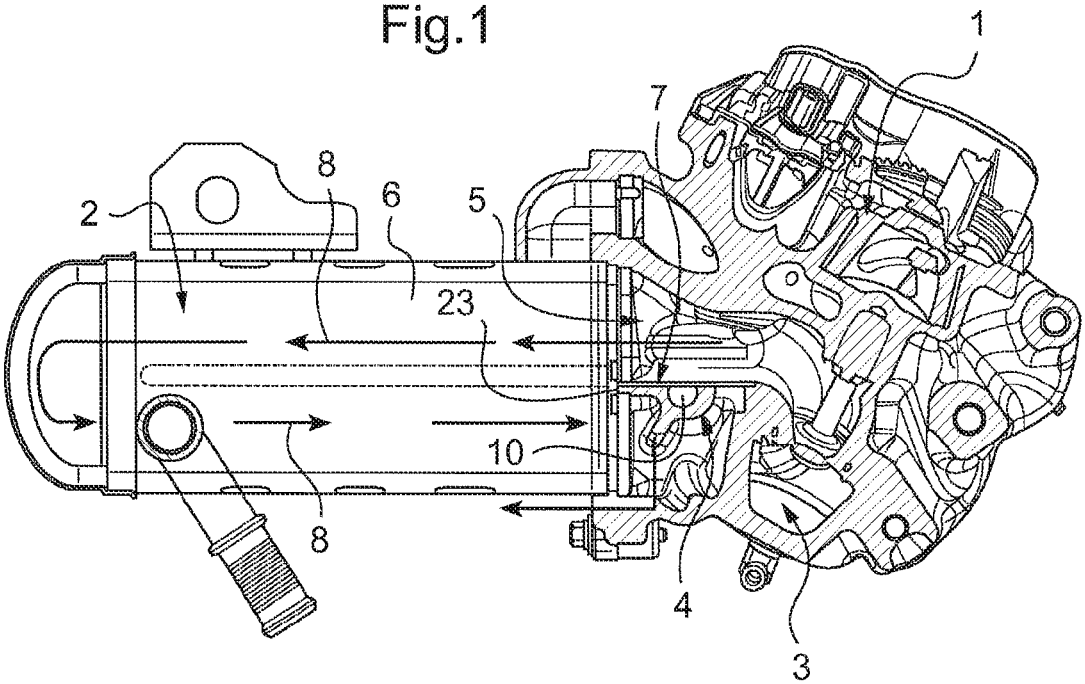

(58) Field of Classification Search
USPC ..... 60/278; 123/568.12, 568.15, 568.17, 123/568.18, 568.23, 568.25, 568.27, 123/568.29; 137/625.43
See application file for complete search history.

(56) References Cited

U.S. PATENT DOCUMENTS 5,911,243 A * 6/1999 Cohen ..... F16K 11/0525 137/625.43
6,039,034 A * 3/2000 Field ..... F02M 25/0773 123/568.18
6,155,296 A * 12/2000 Roman ..... B60H 1/00485 137/625.29
6,367,256 B1 * 4/2002 McKee ..... F02M 25/0707 123/568.12
6,694,736 B2 * 2/2004 Pfluger ..... F01N 13/107 123/559.1
6,698,452 B2 * 3/2004 Sisk ..... F16K 11/0853 137/625.43
7,069,919 B1 * 7/2006 Atkinson ..... F02D 9/101 123/568.18
7,428,897 B2 * 9/2008 Koster ..... F02M 25/0729 123/568.11
7,438,062 B2 * 10/2008 Okawa ..... F16K 1/18 123/568.12
7,617,678 B2 * 11/2009 Joergl ..... F02M 25/0709 123/568.12
7,845,338 B2 * 12/2010 Smith ..... F28D 7/1669 123/568.12
8,011,422 B2 * 9/2011 Yamazaki ..... F02M 37/0029 123/568.12
8,230,681 B2 * 7/2012 Kobayashi ..... 123/568.12
2005/0199381 A1 * 9/2005 Mercz ..... F02M 25/0729 165/172
2005/0268600 A1 * 12/2005 I ..... F01N 3/101 60/288
2007/0017489 A1 * 1/2007 Kuroki ..... 123/568.12
2008/0184974 A1 * 8/2008 Kobayashi ..... 123/568.12
2009/0032129 A1 * 2/2009 Yamawaki ..... F16K 11/0525 137/625.46
2010/0089370 A1 * 4/2010 Furukawa ..... F02M 25/0729 123/568.12
2010/0108041 A1 * 5/2010 Gruner ..... F02M 25/0729 123/568.12
2010/0126478 A1 * 5/2010 Okawa ..... 123/568.12

FOREIGN PATENT DOCUMENTS

WO 2007/079983 A1 7/2007
WO 2009/151681 A2 12/2009
WO 2010/000752 A1 1/2010
WO 2011/129485 A1 10/2011

* cited by examiner

VALVE FOR A GAS FLOW CIRCUIT IN A VEHICLE

The invention relates to a valve for regulating a gas flow circulating in a gas circuit of an automotive vehicle.

Generally, automotive vehicles operating by means of a heat engine use a gas circuit designed to supply said engine during the specific phases of use of the vehicle. Such a circuit has an inlet for air obtained outside the vehicle and comprises a gas supply circuit located upstream of the engine in addition to an exhaust circuit located downstream of said engine to discharge the combusted gases.

Relatively frequently, it arises that such a circuit is provided with at least one EGR (Exhaust Gas Recirculation) loop making it possible to extract a portion of the combusted gases in the region of the exhaust circuit to re-inject said gases into the supply circuit, so that the supply of gas to the engine is provided by a mixture of incident fresh air and combusted gases. Generally, the flow rate of the gases in said EGR loops is regulated by means of a valve coupled to a cooler, to cool said gases during certain temporary and specific operating phases of the engine. Said valves thus comprise a gas inlet and two gas outlets. A first outlet is provided for directly feeding the combusted gases to the supply circuit located upstream of the engine and a second outlet is designed to direct said combusted gases in advance to the cooler in order to cool the gases first before they arrive in said supply circuit. Said valves are provided with a rotating flap, capable of pivoting between a first position in which it blocks the second outlet and causes the gases to pass to the first outlet and a second position in which it closes the first outlet and causes the gases to pass to the second outlet. The rotation of the flap is controlled and carried out automatically from a central computer unit which transmits an appropriate electrical signal at a suitable time. In order to obtain good control of the various gas flows used by the valve, it is important that the flap provides a good seal when it occupies one or other of its two blocked positions inside said valve.

Current valves have a flap of somewhat limited dimensions so that it is able to pivot easily in the valve to such an extent that the valve leaves gaps remaining so that gases pass in the region of the duct which it is designed to block, said gaps being mostly located around said valve. This results in an operation of the EGR loops which is approximate and poorly controlled, putting at risk the operation of the gas supply circuit of the engine.

The valves according to the invention use a flap associated with a specific internal structure of said valve, said flap and said structure interacting to ensure a perfect seal of the flap in at least one of its blocked positions. The opening and closing phases of the valve are thus clean, without permitting the slightest fraction of residual gas to escape, thus making the gas supply circuit perfectly reliable and fully efficient.

The subject of the invention is a valve for regulating a gas flow in an EGR loop of a gas supply circuit of a vehicle engine, comprising a gas inlet, a first gas outlet for directly feeding the gases directly into the supply circuit, and a second gas outlet enabling said gases to flow into a duct passing through a cooler before injecting the gases into said supply circuit, said valve having a rotatable flap capable of pivoting between a first position in which it blocks the second outlet whilst at the same time opening the first outlet and a second position in which it blocks the first outlet whilst at the same time opening the second outlet. In the valve according to the invention, the flap comprises a planar principal body capable of opening or closing the duct, the internal structure of the valve having a planar edge such that the principal body of the flap comes to bear in a planar manner against said edge when said flap is located in the second position thereof. The flap of the valve according to the invention makes it possible to open one outlet and to close the other outlet simultaneously and vice versa. The valve according to the invention has thus been subjected to a dual adaptation in the region of both the duct and the flap, so that the principal body of the flap comes into planar contact with the duct to ensure a sealed opening of the second outlet, without losing gas to the first outlet. In this manner, the valve is able to feed exhaust gases to the cooler of the EGR loop in a clean manner, and thus without losses, before conveying the exhaust gases into the principal gas supply circuit of the engine. More specifically, operating phases of the engine exist, requiring advance cooling of the EGR gases before re-injecting them into the supply circuit of the engine, and other phases for which this advance cooling is not necessary. It is thus particularly important to pass from one configuration to the other in a carefully controlled manner without causing residual leakages of gas due to an approximate interaction between the flap and the internal structure of the valve.

Advantageously, the duct forms a loop with an inlet extending the second outlet of the valve and an outlet opening into the region of the first outlet of said valve, and the flap may have a planar secondary body contiguous with the principal body, said flap being positioned in the valve such that it may pivot about an axis of rotation placed between the principal body and the secondary body, the secondary body being capable of opening or closing the outlet of said duct. It is assumed that the principal body and the secondary body are rigidly connected to one another. When the principal body of the flap blocks the duct permitting the passage of exhaust gases to the cooler, the secondary body also blocks the outlet of said duct and when said principal body opens said duct, the secondary flap opens up the outlet of said duct. The principal body and the secondary body of the flap may be represented by two separate parts or may even consist of one and the same part.

Preferably, the principal body extends in a direction perpendicular to the axis of rotation whilst the secondary body extends in a direction parallel to said axis of rotation.

Advantageously, each of the two lateral edges of the principal body has a relief portion, the internal structure of the valve comprising complementary relief portions, such that the relief portions of the principal body come to bear against the complementary relief portions of said structure to ensure a sealed blocking of the duct. It is noteworthy that the lateral edges of the principal body of the flap are located symmetrically on both sides of the longitudinal axis of said principal body. This complementarity of the relief portions makes it possible for the flap to ensure a closure of the duct with a maximum seal, in the region of the principal body of said flap. A valve according to the invention thus has a flap enabling a sealed closure of the duct and a sealed opening of said duct to be ensured without loss of gas to the first outlet. A relief portion may also be implemented by a depression or a projecting element.

Preferably, the complementary relief portions are positioned on the periphery of an orifice of the internal structure of the valve.

The complementary relief portion(s) may be obtained by machining the internal structure of the valve.

Advantageously, the relief portions of the principal body are represented by two elongated projections extending laterally along said body, each projection having a rounded section, the complementary relief portions being formed by hollow parts in the internal structure of the valve. The principle of this configuration is that the projections are positioned in said hollow parts, in order to ensure tight contact between the internal structure and the flap. The fact that the projections have a rounded shape promotes the sealed conditions by preventing angles from being introduced which could constitute a means for the passage of gas.

Preferably, the free end of each projection and which is the most remote from the secondary body is rounded so as to be best adapted to the hollow parts of the internal structure of the valve. Said additional rounded parts further accentuate the sealed conditions between the flap and the inlet of the duct.

Advantageously, the principal body and the two projections are made in one piece, said projections corresponding to two stamped zones of the principal body. This configuration of the flap is the simplest and the most rapid to produce. The stamping is an operation also enabling a part to be obtained which has a precise geometry.

Preferably, the free end of the secondary body and which is the most remote from the principal body is defined by a rectilinear edge extending parallel to the axis of rotation, said end being chamfered. In other words, this end is progressively reduced in thickness to be terminated by an edge. When the flap is in a position in which the principal body opens the duct and the secondary body blocks the first outlet of the valve, the end of the secondary flap is brought into contact with a bar located in the internal structure of the valve. By chamfering the end of said secondary body, the flap is able to increase its amplitude of rotation, preventing said end from coming into contact too early with said bar. Said chamfer thus makes it possible to increase the amplitude of rotation of the flap so that said flap adopts a satisfactory position in which it ensures the opening of the duct without the loss of gas and ensures a sealed closure of the first outlet. The chamfer may also enable the clearance existing between the end of the flap and the bar to be reduced.

Advantageously, the flap is produced from sheet metal. This material confers a certain degree of flexibility to the flap which is thus able to deform slightly in contact with the duct in order to ensure fully its sealed function when opening or closing said duct.

The valves according to the invention have the advantage of operating cleanly both during the closing phase of the duct and during the opening phase thereof, ensuring a better seal by means of clever adaptations, which are simple and rapid to implement and which are thus inexpensive. More specifically, said adaptations consist in providing small modifications by machining in the region of the inlet of the duct and modifying slightly the geometry of the flap so that the interaction of the flap with the duct is optimized.

A detailed description of a preferred embodiment of a valve according to the invention is provided hereinafter with reference to FIGS. 1 to 7.

Figure 2:
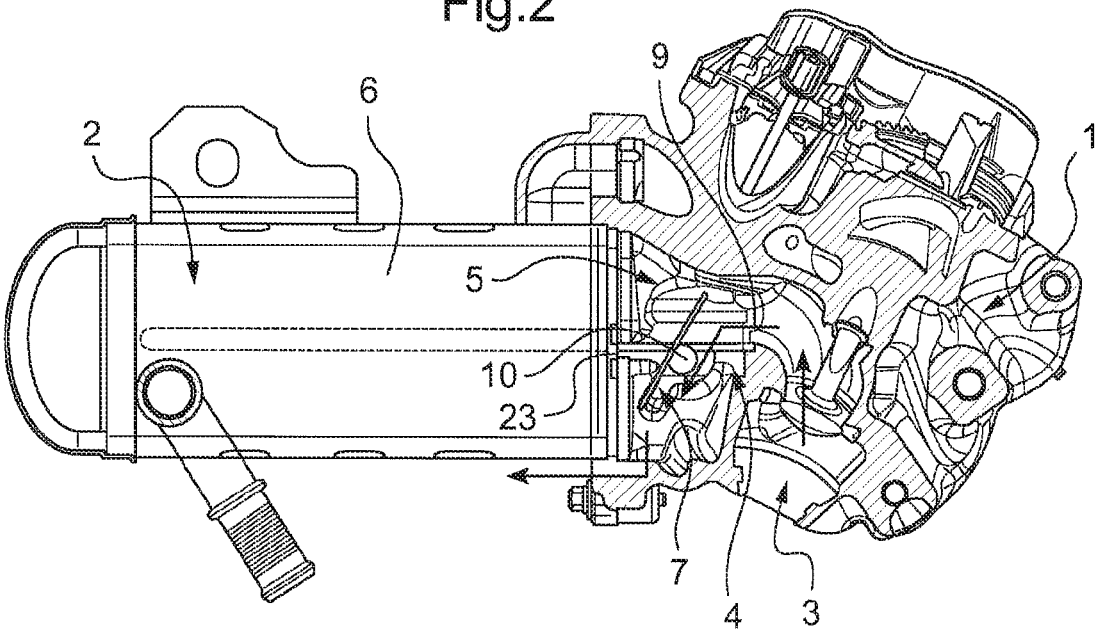
Figure 3:
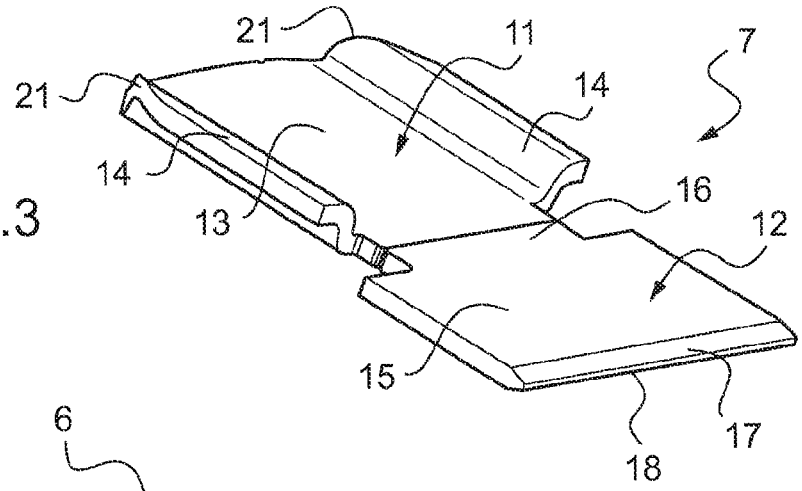
Figure 4:
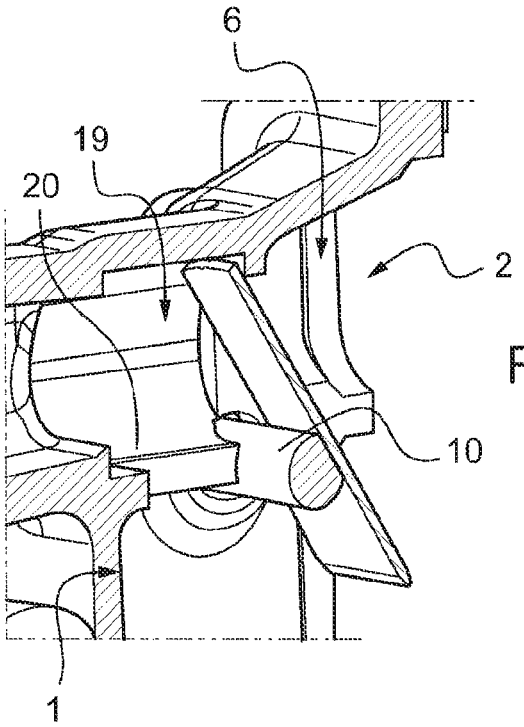
Figure 5A:
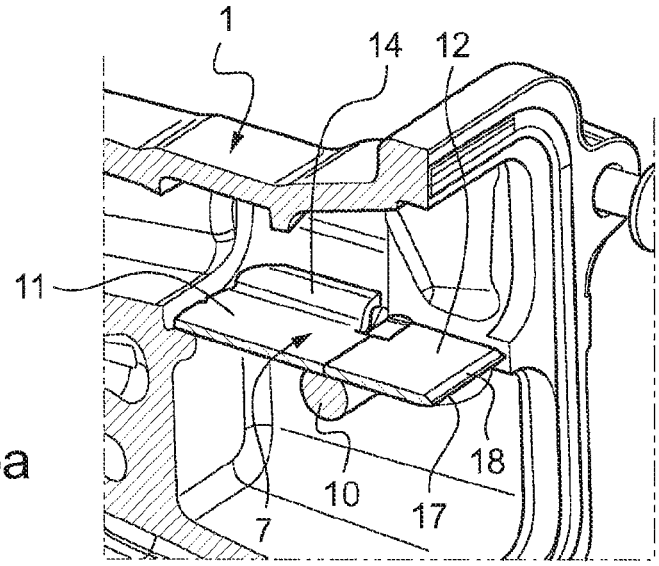
Figure 5B:
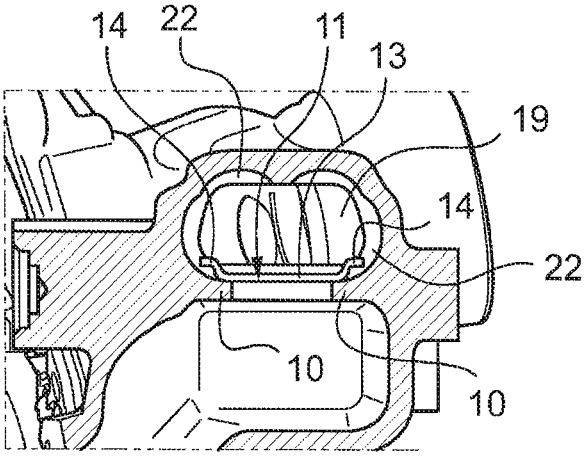
Figure 6:
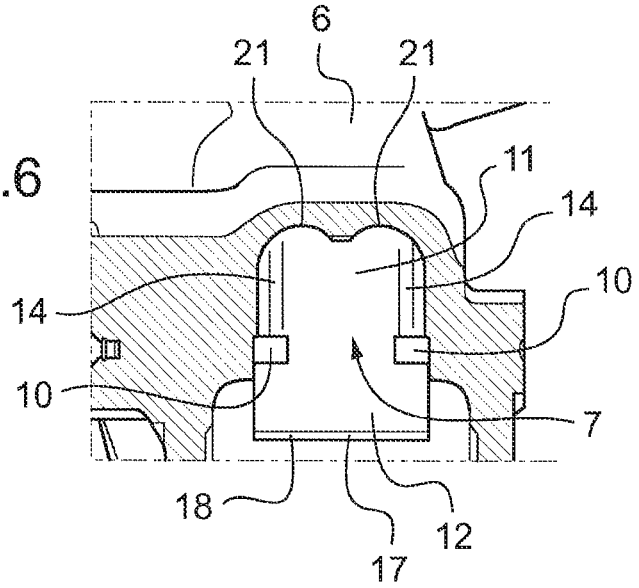
Figure 7:
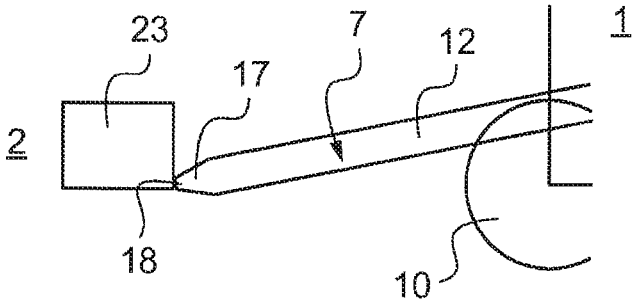

FIG. 1 is a sectional view of an assembly consisting of a valve according to the invention and a cooler, the flap being positioned to pass the gases to the cooler, FIG. 2 is a sectional view of an assembly consisting of a valve according to the invention and a cooler, the flap being positioned to close the access to the cooler, FIG. 3 is a perspective view of a flap belonging to a valve according to the invention, FIG. 4 is a perspective view of the internal structure of a valve according to the invention showing a planar abutment, serving as a stop for the flap 7 in its second position, FIG. 5*a* is a partial perspective view of the internal structure of a valve according to the invention, the flap being in an open position of the duct toward the cooler, FIG. 5*b* is a simplified view of the internal structure and the flap of the valve of FIG. 5*a*, taken from another angle and showing the points of abutment of said flap, FIG. 6 is a simplified view of the internal structure and of the flap of the valve of FIG. 5*b*, the flap being in a blocked position of the duct toward the cooler, FIG. 7 is a schematic view showing the interaction of the flap of a valve according to the invention with a bar separating the flap and the cooler.

With reference to FIGS. 1 and 2, a valve 1 according to the invention is a valve of an EGR loop located in a gas supply circuit of a heat engine of an automotive vehicle. An EGR loop permits one portion of the exhaust gases from the engine to be deviated, to redirect the gases into the part of the supply circuit located upstream of the engine, so that said engine is supplied by a mixture of air and combusted gases. An EGR valve 1 is generally coupled to a gas cooler 2, provided to cool in advance the exhaust gases of said loop before feeding them into the gas supply circuit of the engine, said cooling only being desirable in certain operating modes of the engine. In other words, it is not necessary to cool permanently the gases of the EGR loop. The valve thus has to be designed either to feed the EGR gases directly to the gas supply circuit of the engine, or to enable them to pass in advance via the cooler 2 before conveying them to said supply circuit. A valve 1 according to the invention comprises an air inlet 3, a first gas outlet 4 to feed the gases directly into the supply circuit, and a second outlet 5 permitting said gases to flow into a duct 6 passing through the cooler 2 before injecting said gases into said supply circuit. The duct 6 defines a gas flow circuit passing through the cooler 2, said duct 6 having an inlet 19 extending the second outlet 5 of the valve 1 and an outlet opening into the region of the first outlet 4 of said valve 1. The valve 1 is provided with a pivotably mounted sealing flap 7, provided to adopt a first position in which it blocks the second outlet 5 of the valve 1 whilst at the same time opening the first outlet 4, and a second position in which it blocks the first outlet 4 whilst at the same time opening the second outlet 5 of said valve. The movement in rotation of the flap 7 is controlled automatically by a central computing unit.

FIG. 1 shows the flap 7 in its second position in which it permits the passage of the gases into the duct passing through the cooler 2 in the direction indicated by the arrows 8.

FIG. 2 shows the flap 7 in its first position in which it blocks the duct 6, to feed the gases directly to the supply circuit of the engine in the direction indicated by the arrows 9. The maximum amplitude of rotation of the flap 7 between the first and second positions is less than or equal to 90°. The axis of rotation of the flap 7 is represented by two cylindrical lugs 10 aligned opposite one another and located in the internal structure of the valve 1.

With reference to FIG. 3, the flap 7 of a valve 1 according to the invention comprises a planar principal body 11 and a planar secondary body 12, the two bodies 11, 12 being contiguous with one another and connected rigidly together. The principal body 11 has a planar and rectangular wall 13 of small thickness and two parallel projections 14, extending along a longitudinal axis of the wall 13, said projections 14 forming the two lateral edges of the principal body 11 relative to a central longitudinal axis of said wall. The two projections 14 are identical and are each able to be assimilated into a curved edge having an S-shaped section. The rectangular wall 13, in addition to the two lateral projections 14, constitute the same part, said projections being produced by stamping. The secondary body 12 also has a wall 15 which is planar and rectangular having the same thickness as that of the wall 13 of the principal cylindrical body 11 and is arranged perpendicular to the principal body 11. In other words, a long side of the wall 13 of the principal body 11 is perpendicular to a long side of the wall 15 of the secondary body 12. The secondary body 12 is centered relative to the principal body 11 such that the central longitudinal axis of the principal body 11 intersects the two long sides of the secondary body 12 at the center thereof. The secondary body 12 is extended by a rectangular extension 16, the greatest dimension thereof being equal to the width of the principal body 11, the secondary body 12 being connected to the principal body 11 by means of this extension 16. The free end 17 of the secondary body 12, and which is defined by the long side opposing the extension 16, terminates in a chamfer. In other words, this end 17 is progressively reduced in thickness, so as to be terminated by an edge 18. The free end 21 of each projection 14 which is the end the most remote from the secondary body 12 is of rounded shape. The flap 7 is placed in the valve 1 such that the two cylindrical lugs 10 forming its axis of rotation are located between the principal body 11 and the secondary body 12 of the flap 7. When the flap 7 is located in its second position, corresponding to a blocking of the duct 6, the secondary body makes it possible to block the outlet of said duct 6 opening into the region of the first outlet 4 of the valve 1.

With reference to FIG. 4, the internal structure 19 of the valve 1 enabling the gases to pass from the valve 1 to the cooler 2 has been machined so as to have a planar edge 20 permitting the principal body 11 of the flap 7 to come to bear in a planar manner against said edge 20 when the flap 7 is located in its second position in which it completely opens the second outlet 5 of the valve 1 and blocks the first outlet 4.

This planar bearing of the principal body 11 of the flap 7 on the planar edge 20 of the internal structure 19 of the valve 1 is visible in FIGS. 5*a* and 5*b*. The contact with said planar edge 20 is provided with the wall 13 of the principal body 11 of the flap 7. In this manner, when the flap 7 is fixed in its second position, the connection between said wall 13 and said edge 20 is planar and extensive, permitting a sealed contact to be ensured between said flap 7 and the internal structure 19. With reference to FIG. 5*b*, an overlap is observed between the wall 13 of the principal body 11 of the flap 7 and the planar edge 20 of the internal structure 19 of the valve 1, said overlap preventing any gas to pass between said elements 13, 20 in contact with one another.

With reference to FIG. 5*b*, the periphery of the internal structure of the valve 1, against which the principal body 11 of the flap 7 is designed to come to bear when said flap 7 is located in its first position 4 corresponding to a blocking of the duct 6, has also been machined to allow the machined surface elements 22, which have been slightly hollowed out, to become apparent, substantially having a geometry which is complementary to that of the projections 14 of the flap 7.

More specifically, as FIG. 6 shows, when the flap 7 is in its first position in which its principal body 11 seals the duct 6 toward the cooler 2, said principal body 11 is pressed against the hollow surface elements of the internal structure of the valve 1. More specifically, it is the projections 14 of this principal body 11, the shapes thereof being complementary to those of the surface elements 22, which are pressed against said surface elements 22, without leaving gaps remaining for the passage of the gases. This contact is all the more tight if the flap 7 is capable of deforming elastically to permit the projections 14 to create better contact with said surface elements 22.

With reference to FIGS. 1, 2 and 7, the valve 1 and the cooler 2 are separated by a wall comprising a protruding bar 23. When the flap 7 is displaced in rotation from its first position to its second position, the chamfered end 17 of the secondary body 12 of the flap 7 is brought, at the end of travel, to come into contact with said bar 23. The fact that said end is terminated by a chamfer defined by a fine edge 18, makes it possible to extend by several degrees the amplitude of rotation of said flap 7, preventing said end 17 from being blocked too early against said bar 23. In this manner, the flap 7 is able to carry out a complete rotation, permitting it to occupy its second position ensuring a complete seal without the leakage of gas to the first outlet 4 of the valve 1.

As a variant, in the second position, a clearance may exist between the chamfered end 17 of the secondary body 12 of the flap and the bar 23.

The invention claimed is:

1. A valve for regulating a gas flow in an EGR loop of a gas supply circuit of a vehicle engine, comprising:

a gas inlet;

a first gas outlet for directly feeding the gases into the supply circuit;

a second gas outlet enabling said gases to flow into a duct passing through a cooler before injecting said gases into said supply circuit;

a rotatable flap capable of pivoting between a first position in which blocks the second outlet whilst at the same time opening the first outlet and a second position in which the flap blocks the first outlet whilst at the same time opening the second outlet, the flap comprising a planar principal body capable of opening or closing the duct, said duct having a planar edge such that the principal body of the flap comes to bear in a planar manner against said edge when said flap is located in the second position thereof, the duct forming a loop with an inlet extending the second outlet of the valve and an outlet opening into the region of the first outlet of said valve, the flap having a planar secondary body contiguous with the principal body, said flap being positioned in the valve such that it may pivot about an axis of rotation placed between the principal body and the secondary body, the secondary body being capable of opening or closing the outlet of said duct, wherein the principal body is elongated in a first direction, perpendicular to the axis of rotation; and wherein the secondary body is elongated in a second direction, parallel to the axis of rotation.

2. The valve as claimed in claim 1, wherein two lateral edges of the principal body each have a relief portion and wherein the internal structure of the valve comprises complementary relief portions such that the relief portions of the principal body come to bear against the complementary relief portions of said structure to ensure a sealed blocking of said duct.

3. The valve as claimed in claim 2, wherein the complementary relief portions are positioned on a periphery of an orifice of the internal structure of the valve.

4. The valve as claimed in claim 2, wherein the relief portions of the principal body are represented by two elongated projections extending laterally along said body, each projection having a rounded section and in that the complementary relief portions are formed by hollow parts in the internal structure of the valve.

5. The valve as claimed in claim 4, wherein a free end of each projection which is most remote from the secondary body is rounded so as to be best adapted to the hollowed parts of the internal structure of the valve.

6. The valve as claimed in claim 4, wherein the principal body and the two projections are made in one piece, said projections corresponding to two stamped zones of the principal body.

7. The valve as claimed in claim 1, wherein a free end of the secondary body which is most remote from the principal body is defined by a rectilinear edge extending parallel to the axis of rotation, said end being chamfered.

8. The valve as claimed in claim 1, wherein the flap is produced from sheet metal.

* * * * *